US006655796B2

(12) United States Patent
Sharma

(10) Patent No.: US 6,655,796 B2
(45) Date of Patent: Dec. 2, 2003

(54) POST-PRINT TREATMENT FOR INK JET PRINTING APPARATUS

(75) Inventor: Ravi Sharma, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/028,143

(22) Filed: Dec. 20, 2001

(65) Prior Publication Data

US 2003/0117471 A1 Jun. 26, 2003

(51) Int. Cl.[7] ..... B41J 2/17
(52) U.S. Cl. ..... 347/95; 347/102; 428/195
(58) Field of Search ..... 347/100, 101, 347/102, 95; 427/189–195, 180, 202, 204, 421, 427, 258

(56) References Cited

U.S. PATENT DOCUMENTS

| | | | | |
|---|---|---|---|---|
| 4,582,731 A | | 4/1986 | Smith | |
| 4,785,313 A | | 11/1988 | Higuma et al. | |
| 4,832,984 A | | 5/1989 | Hasegawa et al. | |
| 4,923,720 A | * | 5/1990 | Lee et al. | 427/422 |
| 5,057,342 A | | 10/1991 | Hoy et al. | |
| 5,330,783 A | | 7/1994 | Saidman et al. | |
| 5,633,044 A | | 5/1997 | Linnonmaa | |
| 5,698,330 A | | 12/1997 | Bederke et al. | |
| 6,013,326 A | | 1/2000 | Flosbach et al. | |
| 6,165,560 A | | 12/2000 | McClain et al. | |
| 6,187,383 B1 | | 2/2001 | McClain et al. | |
| 6,190,739 B1 | | 2/2001 | Höffer et al. | |
| 6,194,650 B1 | | 2/2001 | Wakayama et al. | |
| 6,200,637 B1 | | 3/2001 | McClain et al. | |
| 6,200,639 B1 | | 3/2001 | Duecoffre et al. | |
| 6,221,435 B1 | | 4/2001 | Nielsen | |
| 6,283,589 B1 | * | 9/2001 | Gelbart | 347/101 |
| 6,340,722 B1 | * | 1/2002 | Lee et al. | 524/428 |
| 6,464,348 B1 | * | 10/2002 | Kasperchik et al. | 347/101 |

FOREIGN PATENT DOCUMENTS

| | | |
|---|---|---|
| EP | 0 858 905 A1 | 8/1998 |
| EP | 0 858 906 A1 | 8/1998 |

* cited by examiner

*Primary Examiner*—Stephen D. Meier
*Assistant Examiner*—Ly T Tran
(74) *Attorney, Agent, or Firm*—Milton S. Sales

(57) ABSTRACT

An inkjet printing apparatus includes a printing assembly adapted to create inkjet images on a medium. A durability station provided in series with the printing assembly is adapted to apply direct a durability material in solution with a supercritical carbondioxide solvent onto the medium to provide an overcoat for protecting inkjet prints.

8 Claims, 3 Drawing Sheets

POST-PRINT TREATMENT FOR INK JET PRINTING APPARATUS

CROSS-REFERENCE TO RELATED APPLICATION

Cross reference is made to commonly assigned co-pending U.S. patent application Ser. No. 09/684,183 filed in the names of Mark S. Janosky et al. on Oct. 6, 2001.

FIELD OF THE INVENTION

The present invention relates to a inkjet apparatus for printing images, more particularly to such apparatus that coats the images with a durable material.

BACKGROUND OF THE INVENTION

Durability is a performance criterion that is expected by consumers of photographic and other prints. This criterion includes resistance to tearing, fading, water and chemical exposure plus numerous other factors. In the current state of the art, silver halide prints demonstrate a high degree of overall durability in relation to inkjet. This fact is one of the reasons why inkjet near photographic quality printing technologies are not completely supplanting the silver halide share of the market. However, these other technologies are rapidly improving durability through the addition of materials and processes.

One example of a non-silver halide printing process that produces a durable photographic quality print is the Kodak Picture Maker. The Kodak Picture Maker creates durable prints by using the same thermal dye diffusion printing process that is used to produce the image on the media. Specifically, this printing process is one in which dye is transferred from a donor ribbon to media by means of heating a thermal print head while the print head, donor ribbon and media are in mechanical contact. By performing this process in a serial fashion for three separate primary color patches (sometimes there is a fourth black patch) in a controlled manner, an image can be produced on the media. To ensure durability, this printing process is performed one more time except that instead of dye transfer, a continuous clear overcoat material is transferred to the media. This process is often referred to as peel-apart or thermal transfer overcoat (TTO).

A second example of a non-silver halide printing process that produces a durable photographic quality print is the Canon Hyperphoto. Patents associated with this type of process are U.S. Pat. Nos. 4,832,984 and 4,785,313, as well as European Patents 0 858 905 A1 and 0 858 906 A1. In the Canon Hyperphoto, the original media has already been pre-coated with a special chemical layer prior to printing (actually done during the production of the media). This coating is designed such that during the inkjet printing process, the inks can penetrate the layer and stabilize on an ink-receiving layer below the special coating. The Canon Hyperphoto then uses a heated fuser to seal this top coating over the image after the print cycle is complete. This process is often referred to as incorporated since the durability material is already incorporated into the media prior to printing.

Recently, inkjet printing has become a popular method for printing photographic quality images. Inkjet printing is now being developed for retail photofinishing. While the printed images are of high quality, inkjet prints suffer from a number of disadvantages relative to other hard copy out puts. In particular inkjet prints have poor water fastness, light fastness, finger print resistance, and abrasion resistance. Thus there is a need for improved dye chemistry and improved overcoats. Further more, in order to increase inkjet printing through put a fast-drying receiver is required. Fast drying receivers are porous and are low gloss. Thus, an overcoat is also useful increasing the gloss of the printed image.

Overcoats could potentially provide a low cost solution because the desired protection may be packed into one layer. Hydrophobic polymers may be used to eliminate water penetration. The polymers may also be formulated to reduce the permeation of gas such as ozone that are known to bleach dyes. The overcoat may also be packed with UV screening agents to improve light fastness. Adhesion promoters such as copolymers and wetting agents may be formulated into the over coat to provide defect-free coatings that will not blister or delaminate. These ideas are being incorporated in current overcoat formulations with some success but they suffer from cost, waste, and difficulties in providing adequate protection while balancing environmental concerns at the point of use.

A polymer formulation to be coated at the point of use after a print is generated requires a solvent that meets a higher environmental standard. Solvents that are odorous, flammable and hazardous will not be acceptable. Hydrophobic polymers that provide the best protection against water damage are incompatible with a water solvent. Compromises of using hydrophilic-hydrophobic copolymers would not be effective because they are not as effective against fingerprints and abrasion. Hydrophobic lattices dispersed in water could potentially be useful but coated films are prone to pinhole defects that allow water to penetrate. They also require considerable annealing to allow the lattices to coalesce and form a continuous film. This may require extra equipment such as heaters or fusing rollers, which adds to cost and detracts from high productivity.

Even if water were to be used as the solvent, considerable cost would be associated with the removal of the water solvent. This requires a drying station, which adds to cost and productivity. When receivers are loaded with water, the receiver tends to cockle after drying. Therefore, some cost savings in the receiver design may be realized if the overcoat does not increase solvent burden on the receiver.

Supercritical carbondioxide has been studied as alternative solvent for organic materials such as high molecular weight polymers, hydrophobic polymers, surfactant copolymers, and drugs. It has been suggested as an environmentally friendly solvent.

SUMMARY OF THE INVENTION

It is a feature of the present invention that supercritical carbondioxide be used as solvent in providing overcoats for protecting inkjet prints. The advantages of using supercritical carbondioxide include the following:

1. The range of polymers can be used is be greater than if water were the solvent because supercritical carbondioxide is a better solvent than water. For example, the permissible polymers include high molecular weight hydrophobic materials. In particular, polymeric components include vinyl, acrylic, styrenic, siloxane, urethane monomers and interpolymers of the base vinyl, acrylic and styrenic, siloxane and urethane monomers; poly (methylmethacrylate), organo-silane, cellulosic esters, polyesters, and fluorinated polymers may potentially be used with a supercritical carbondioxide solvent.
2. Supercritical carbondioxide is environmentally friendly.

3. Using supercritical carbondioxide as solvents eliminates the need of a drying station because supercritical carbondioxide rapidly converts to a gas. The risk of receiver cockle is reduced or eliminated.
4. Supercritical carbondioxide dries rapidly improving productivity.

The above and other objects, advantages and novel features of the present invention will become more apparent from the accompanying detailed description thereof when considered in conjunction with the following drawings.

BRIEF DESCRIPTION OF THE DRAWINGS

In the detailed description of the preferred embodiments of the invention presented below, reference is made to the accompanying drawings in which.

DETAILED DESCRIPTION OF THE INVENTION

The present description will be directed in particular to elements forming part of, or in cooperation more directly with, the apparatus in accordance with the present invention. It is understood that elements not specifically shown or described may take various forms well known to those skilled in the art.

Figure 1:
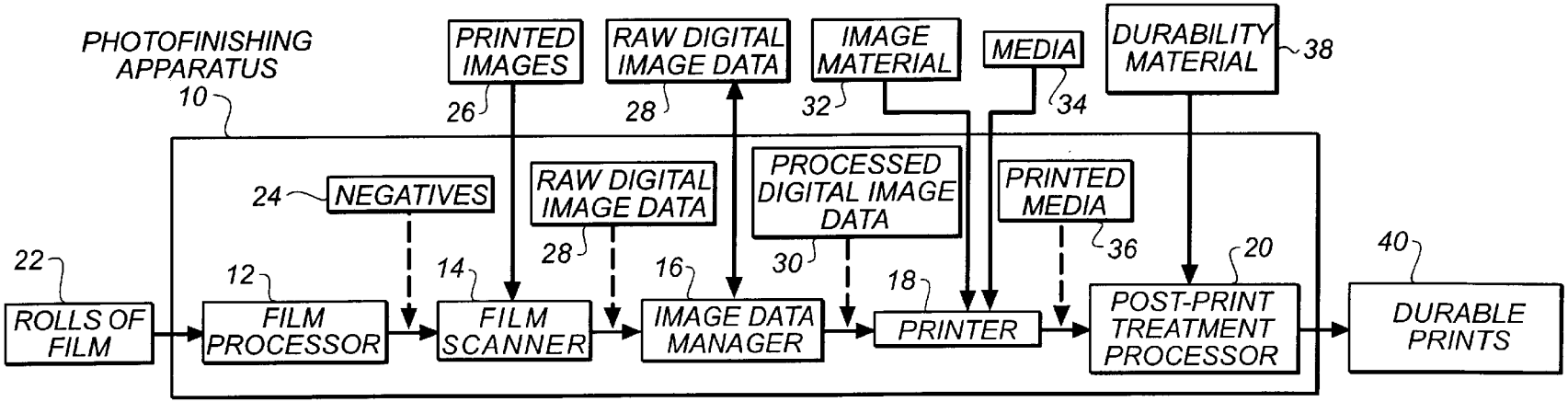
FIG. 1 is a photofinishing apparatus block diagram.

Referring now to the drawings, wherein like reference numerals represent similar or corresponding parts throughout the several views. FIG. 1 illustrates a block diagram of a generic photofinishing apparatus 10. Photofinishing apparatus 10 is partitioned into five major subsystems. These subsystems include a film processor 12, a film scanner 14, an image data manager 16, an inkjet printer 18, and a finisher or post-print treatment processor 20. The basic functions of each of these systems are described as follows. Film processor 12 chemically processes rolls of film 22 (orders) into negatives 24. Scanner 14 digitizes negatives 24 or other printed images 26 into raw digital image data 28. Image data manager 16 performs image processing on raw digital image data 28 (either from an outside source or from film scanner 14) and converts this raw digital image data 28 into processed digital image data 30. Inkjet printer 18 then uses this processed digital image data 30, image materials (inks) 32 (including ink) and media 34 to produce printed media 36. Finally, finisher or post-print treatment processor 20 performs any operation following printing (such as back printing, drying, durability application of a durability material 38, cutting, and/or print sorting) which results in durable prints 40.

Figure 2:
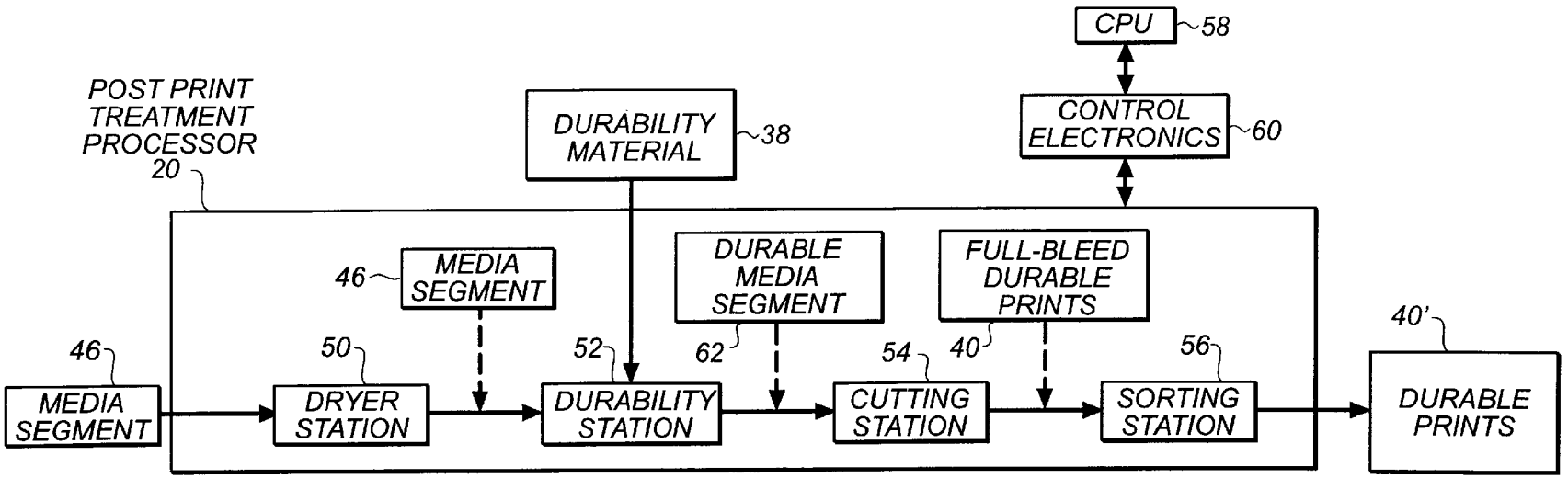
FIG. 2 is a post-print treatment processor block diagram.
Figure 3:
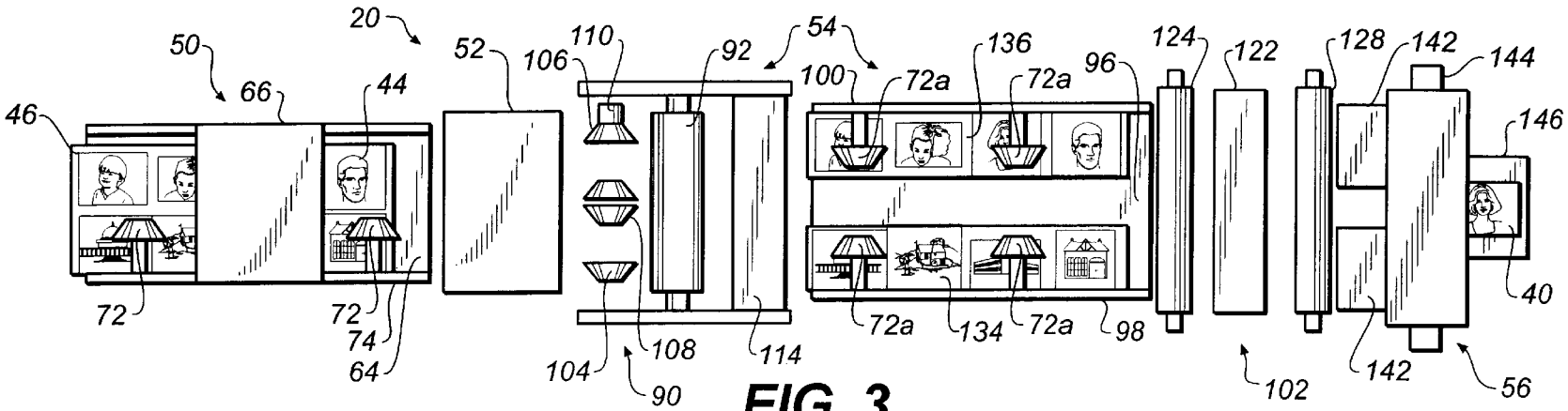
FIG. 3 shows a top view of a preferred embodiment of the apparatus of the invention.

There are three basic formats of printed media 36 as it leaves printer 18. The first format is printed media 36 that is already cut into prints 40. The second format is printed media 36 that have a plurality of images on a media segment 46 (FIGS. 2 and 3). The third and final format is printed media 36 that is continuous or in a roll form (not shown).

While each format demonstrates some advantages over the others, and the present invention is applicable to all formats, the illustrative embodiment of the present invention will be the media segment 46 format which includes multiple images on a print, as well as borders along the edges and between the images.

FIG. 2 illustrates a block diagram of the illustrative embodiment of post-print treatment processor 20. Post-print treatment processor 20 is partitioned into four major process stations. These process stations include a drying station 50, a durability station 52, a cutting station 54, and a sorting station 56. The machine control of these stations is performed by a control computer (CPU) 58 and control electronics 60.

Drying station 50 performs any necessary drying prior to any durability application or fixing that will take place. Durability station 52 performs the function of applying a liquid overcoat of durability material 38 to media segment 46 to produce a durable media segment 62. Cutting station 54 performs the function of converting durable printed media 62 into durable prints 40. Finally, sorting station 56 performs the function of taking durable prints 40 from cutting station 54 and organizing them in a way that the photofinisher can return the durable prints 40 to a customer as sorted durable prints 40'.

Figure 4:
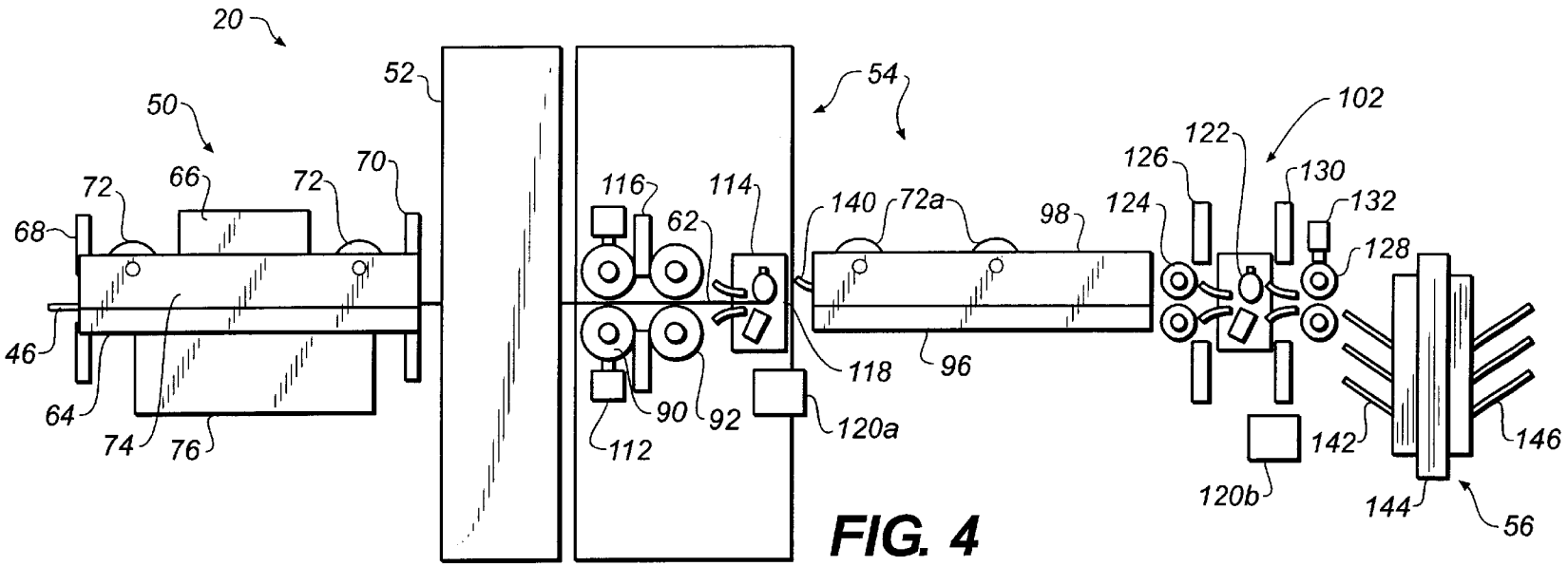
FIG. 4 shows a side view of the preferred embodiment of the apparatus of the invention.

The process thread that holds these stations together is the basic media transport that occurs throughout post-print treatment processor 20. This transport encompasses a further feature of the invention. FIGS. 3 and 4 illustrate the detailed architecture of a preferred embodiment of post-print treatment processor 20 that pertains to this invention. These figures illustrate the top and side view perspectives, and can be referenced along with FIG. 2 for the rest of the description.

As noted, printer 18 can use any preferred printing technology but should be able to produce a media segment 46 that has a plurality of printed images 44 (FIG. 3). The plurality of images 44 may be tiled or positioned on media segment 46 in numerous combination forms with borders between the images and/or along the edges of the images. These combinations are mainly a function of the geometry of media segment 46, the print formats that can be worked with by the overall photofinishing apparatus 10, and the statistical image makeup of film or digital orders being processed by photofinishing apparatus 10.

Drying station 50 receives media segment 46 as follows. The lead edge of a media segment 46 feeds onto a front platen 64 from printer 18 and an entrance detection sensor 68 detects it. This detection allows control computer 58 to begin the control of the drying and transport functions through control electronics 60. First, a dryer 66 is set to an appropriate temperature. Next, a set of urge rollers 72 that are used to transport media segment 46 through drying station 50 are sped up to the appropriate speed. This speed is set so as to allow the desired amount of drying to take place as media segment 46 passes under dryer 66 and moves toward durability station 52.

Next, the same urge rollers 72 that provide the basic forward motion transport are used in combination with a front platen edge guide 74 and a front platen alignment mechanism 76 to perform an alignment function for upstream cutting station 54. Basically, urge rollers 72 use conical shaped rollers that provide forward and lateral motion simultaneously. By designing the frictions and loads between urge rollers 72, media segment 46 and front platen 64 correctly, media segment 46 will straighten out and ride with one side edge against front platen edge guide 74. At this point, the alignment now is dependent on the alignment of front platen 64 and durability station 52. This is accomplished by using front platen alignment mechanism 76 that is adapted to allow all or some of the six rigid body degrees-of-freedom of front platen 64 to be adjusted.

Figure 5:
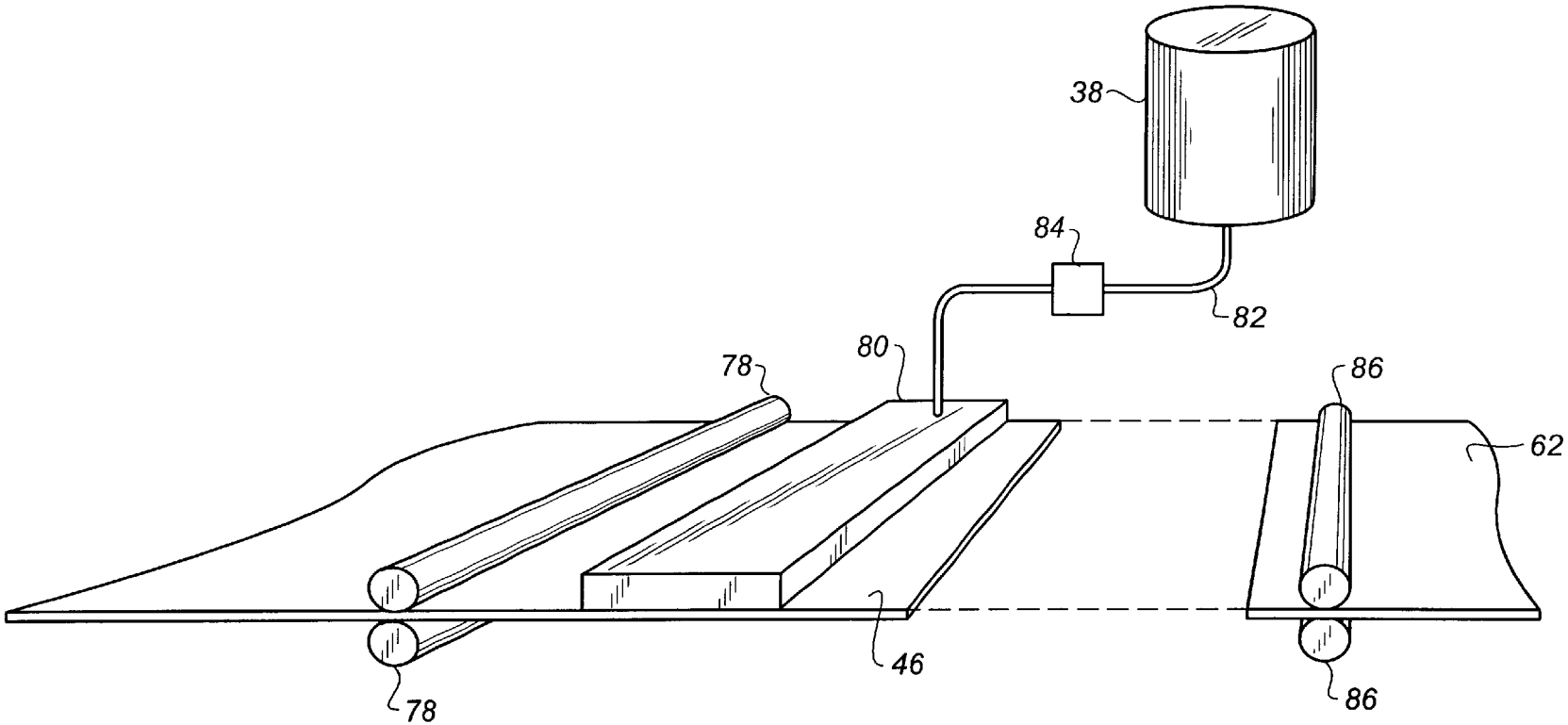
FIG. 5 is a detailed view of a portion of the photofinishing apparatus of FIGS. 1–4.

Exiting drying station 50, media segment 46 will trigger an exit detection sensor 70 within drying station 50. The signal generated by exit detection sensor 70 will be used by control computer 58 and control electronics 60 to start the durability treatment process as the media segment 46 approaches the entrance of durability station 52. Referring to FIG. 5, the entrance to durability station 52 is a nip created by a pair of rollers 78. Before entrance of a media segment, durability station 52 has been placed in an idle mode to minimize waste.

Exiting the nip of rollers 78, media segments 46 are transported below a nozzle head 80 having an array of spray nozzles, not shown, spaced (but not necessarily aligned) across the path of the media segments. The nozzle head is in fluid communication via a conduit 82 with reservoir 38 of durability material in solution with a supercritical carbondioxide solvent. Conduit 82 is valved at 84 under the control of CPU 58. Durable media segments 62 exit durability station 52 through a nip created by a second pair of rollers 86.

The durability material may be pure, such that a powdery material may be deposited on the media segment upon conversion of the supercritical carbondioxide to a gas. It is possible that an additional step would be needed to fuse the powder. Alternatively, a second, co-solvent may be carried by the durability material so that a fusing step is not required. Such a co-solvent might, for example, be a ketone, an alcohol, a glycol ether, a hydrocarbon, etc.

After station 52, media segment 46 is ready to go through a two-axis cutting process within cutting station 54. Cutting station 54 is comprised of a slitting station 90, a pull roller set 92, a segment chopping station 114, a rear platen 96 (including urge rollers 72*a*), a rear platen right edge guide 98, a rear platen left edge guide 100, and a print chopping station 102. Slitting station 90 is further broken down into a right edge slitter 104, a left edge slitter 106, a center slitter 108, an edge slitter position mechanism 110 and a center slitter retract mechanism 112. Segment chopping station 114 is further broken down into a segment detection sensor 116, a waste control mechanism 118, and a waste drawer 120*a*. Print chopping station 102 is further broken down into a print chopper 122, a lead edge metering roller set 124, a lead edge sensor 126, a trail edge metering roller set 128, a trail edge sensor 130, a metering roller retract mechanism 132 and another waste drawer 120*b*.

As media segment 62 is pulled through slitting station 90, right edge slitter 104, left edge slitter 106, and center slitter 108 are engaged. As pull rollers 92 pull media segment 62 through slitting station 90, media segment 62 is actually split into two new media segments, a right split media segment 134 and a left split media segment 136 (FIG. 3). The waste material generated by the slitting operation is deposited into waste drawer 120*a*.

Pull rollers 92 push right split media segment 134 and left split media segment 136 between the respected sets of urge rollers 72*a* and rear platen 96. A set of spring fingers 140 aids this guidance action. This pushing action continues until segment detection sensor 116 detects the media segment trail edge of the right split media segment 134 and left split media segment 136. The signal from this detection is used by the intelligence of control computer 58 and control electronics 60 to drive right split media segment 134 and left split media segment 136 until their trail edge is just slightly downstream of segment chopper 114.

At this point, the entire transport system of post-print treatment processor 20 is shutdown and durability station 52 is put into an idle mode again. As the right split media segment 134 and left split media segment 136 rest on rear platen 96, segment chopper 114 is activated and a single cut is made. The two split media segments are now completely independent of one another.

Once the right split media segment 134 and left split media segment 136 (FIG. 3) are separated from one another, they need to be aligned for the final print chopping process. This alignment process begins by allowing urge rollers 72*a* associated with right split media segment 134 to drive the segment toward print chopping station 102. The alignment occurs in the exact same manner as was described for front platen 64. Beginning with the right side, urge rollers 72*a* use their conical shape to laterally move the right split media segment toward the rear platen right edge guide 98 while simultaneously moving the right split media segment 134 toward print chopping station 102. This same action can occur in parallel or in series between the left split media segment 136 and the rear platen left edge guide 100. At this point, either the right split media segment 134 or left split media segment 136 is ready to be chopped into durable prints 40.

Right split media segment 134 and left split media segment 136 are ready to be print chopped. FIG. 4 illustrates the use of single print chopper 122 such as a known guillotine or rotary chopper. Two print choppers would allow the overall throughput to be improved. With single print chopper 122, the act of cutting right split media segment 134 and left split media segment 136 into durable prints 40 occurs as follows. Urge rollers 72*a* feed split media segment 134 forward so that the lead edge enters the nip of lead edge metering rollers 124. Lead edge metering rollers 124 are already accelerated to a constant velocity and after they grab right split media segment 134 it essentially has taken the transport control away from urge rollers 72*a*. Lead edge metering rollers 124 transports right split media segment 134 forward until the media lead edge within the segment is detected by lead edge sensor 126. Since the location of the plurality of images 44 are known relative to this lead edge, lead edge metering rollers 124 begin to position right split media segment 134 within print chopper 122. There are two basic cutting processes that can be used at this point. One process is to perform the entire cut in one cutting stroke. The second process is to perform the required cut by using a series of small cuts and metering jogs. Using either method results in the waste media falling into waste drawer 120*b* below print chopper 122.

Once the waste media is trimmed off from the lead edge of the first image, lead edge metering rollers 124 transport right split media segment 134 towards trail edge metering rollers 128. At this point, trail edge retract mechanism 132 has opened the nip of trail edge metering rollers 128. This is done in order that the lead edge of right split media segment 134 can easily be pushed through this nip and positioned such that the trail edge of the image can be chopped. Once positioned, trail edge retract mechanism 132 closes and print chopper 122 is activated. This action now separates a finished print 40 from the rest of right split media segment 134. Finished print 40 is now transported to one of entrance chutes 142 on sorting station 56. The same print chopping cycle is repeated for the plurality of images 44 on the rest of the right split media segment 134. Once complete, the exact same process can be performed for the left split media segment 136.

As noted trail edge metering rollers 128 act as the transport mechanism for moving durable prints 40 into sorting station 56. Sorting station 56 is the final process and is composed of a set of entrance chutes 142, an elevator mechanism 144, a set of exit trays 146 additional urge rollers (not shown). As noted before, sorting station 56 is functionally the mechanism that accepts durable prints 40 and stacks them in an appropriate manner which makes it easy for the photofinisher to get the durable prints 40 back to the customer. As with some of the other systems in this description, sorting station 56 in its own right is very complicated and is not the focus of this invention. However, the embodiment used in this invention simply allows elevator mechanism 144 to raise entrance chutes 142 such that a given finished print can be transported into one of the chutes. The finished print then slides down the chute due to gravity and is allowed to be transported to a selected exit tray 146 by means of urge rollers (not shown) associated with that exit tray. This process is controlled under the intelligence of control computer 58 and control electronics 60.

The invention has been described in detail with particular reference to certain preferred embodiments thereof, but it will be understood that variations and modifications can be effected within the spirit and scope of the invention.

What is claimed is:

1. An ink jet printing apparatus comprising:

a printing assembly adapted to create ink jet images on a medium; and a durability station provided in series with said printing assembly and adapted to direct a durability material in solution with a supercritical carbondioxide solvent toward the medium such that the durability material is applied to the medium in a powder state.

2. An inkjet printing apparatus according to claim 1, wherein said durability station includes apparatus for spraying the solution toward the medium.

3. An ink jet printing apparatus according to claim 1, further comprising apparatus that fuses the powder durability material to the medium.

4. An inkjet printing apparatus according to claim 1, wherein durability station is adapted to apply durability material with a second, co-solvent carried by the durability material.

5. An ink jet printing apparatus according to claim 1, wherein the co-solvent carried by the durability material is selected from a group of solvents including ketone, alcohol, glycol ether, and hydrocarbon.

6. A process for applying a durability coating to an ink jet print, said process comprising:

printing an image on a medium by ink jet technology; and spraying a solution of a durability material in a supercritical carbondioxide solvent toward the medium, such that the durability material is material is applied to the medium in a powder state.

7. A process as set forth in claim 6 further comprising the step of fusing the powder durability material to the medium.

8. A process as set forth in claim 6 wherein the spraying step applies durability material with a second, co-solvent carried by the durability material.

* * * * *